US011856996B2

(12) United States Patent
Guo et al.

(10) Patent No.: US 11,856,996 B2
(45) Date of Patent: Jan. 2, 2024

(54) ELECTRONIC CIGARETTE USING A MAGNET FOR COMMUNICATION

(71) Applicant: Red Coral IP Holding Company, Inc., Middletown, DE (US)

(72) Inventors: Xingchen Guo, Irvine, CA (US); Yong Fu, Shenzhen (CN)

(73) Assignee: Red Coral IP Holding Company, Inc., Middletown, DE (US)

( * ) Notice: Subject to any disclaimer, the term of this patent is extended or adjusted under 35 U.S.C. 154(b) by 492 days.

(21) Appl. No.: 17/189,027

(22) Filed: Mar. 1, 2021

(65) Prior Publication Data

US 2022/0273040 A1 Sep. 1, 2022

(51) Int. Cl.

| | |
|---|---|
| ***A24F 47/00*** | (2020.01) |
| ***A24F 40/50*** | (2020.01) |
| ***A24F 40/65*** | (2020.01) |
| ***A24F 40/42*** | (2020.01) |

(52) U.S. Cl.

CPC ..... *A24F 40/50* (2020.01); *A24F 40/42* (2020.01); *A24F 40/65* (2020.01)

(58) Field of Classification Search

CPC ..... A24F 40/42; A24F 40/50; A24F 40/65

See application file for complete search history.

(56) References Cited

U.S. PATENT DOCUMENTS

| | | | | |
|---|---|---|---|---|
| 2013/0220315 | A1* | 8/2013 | Conley | A24F 40/44 128/202.21 |
| 2020/0120982 | A1* | 4/2020 | Tanabe | A24F 40/42 |
| 2022/0016364 | A1* | 1/2022 | Kilger | A61M 11/042 |
| 2023/0200453 | A1* | 6/2023 | Kilger | A24F 40/30 131/329 |
| 2023/0240381 | A1* | 8/2023 | Butin | H02J 7/0047 235/451 |

* cited by examiner

*Primary Examiner* — Eric Yaary

(74) *Attorney, Agent, or Firm* — WHGC, P.L.C.; Alexander R. Schlee

(57) ABSTRACT

An electronic cigarette and its host device and cartridge detachably attached to the host device, and a method of operating the same. When the cartridge is detachably attached to the host device a communication magnet provides a connecting force between the host device and the cartridge and at the same time establishes and electrically conducting connection between the host device and the cartridge allowing the transmission of data through the communication magnet to authenticate the cartridge and read operating parameter from the cartridge for optimized controlling.

12 Claims, 6 Drawing Sheets

ELECTRONIC CIGARETTE USING A MAGNET FOR COMMUNICATION

TECHNICAL FIELD OF THE INVENTION

The present invention relates to the technical field of electronic cigarettes, and in particular, to an electronic cigarette using magnet for communication.

BACKGROUND OF THE INVENTION

There are many kinds of electronic cigarettes having the magnetic attraction function on the market, with good user experience.

However, the magnet, which only has the magnetic attraction function as a single function, occupies a relatively large part in the small space of an electronic cigarette.

SUMMARY OF THE INVENTION

It is an object of the invention to provide an electronic cigarette to maximize the number of electrical contacts while maintaining a simple design.

According to a first aspect of the invention, an electronic cigarette comprises a host device and a cartridge; wherein said cartridge is detachably attached to the host device; the host device comprises a first controller, a communication magnet, and a first electrical contact electrical contact pin, wherein the communication magnet and the first electrical contact pin are electrically connected with the first controller; the cartridge comprises a cartridge body, a second controller, and a second electrical contact pin, wherein the second controller is electrically connected with the communication magnet for transmitting data to the first controller through the communication magnet, and the second electrical contact pin is electrically connected with the second controller and is electrically connected with the first electrical contact pin for providing electrical power; and the communication magnet provides a connecting force between the host device and the cartridge when the cartridge is detachably attached to the host device.

According to a second aspect of the invention an electronic cigarette host device, is configured to be detachably connected to a cartridge, said host device comprising: a first controller, a communication magnet, and a first electrical contact pin, wherein the communication magnet and the first electrical contact pin are electrically connected with the first controller; and the communication magnet is configured to connect in an data transmitting fashion allowing date to be transmitted through said communication magnet to a second controller provided in the cartridge, wherein said communication magnet provides for both data transmission between the first and second controllers and for providing a magnetic attraction force between the host device and the cartridge when the cartridge is detachably attached to the host device.

According to a third aspect of the invention an electronic cigarette cartridge, is configured to be detachably connected to a host device, said cartridge comprising: a cartridge body, a second controller, and a second electrical contact pin, wherein the cartridge is adapted to be electrically connected via a communication magnet in a data transmitting fashion to a first controller transmitting data through the communication magnet, and the second electrical contact pin is electrically connected with the second controller and is electrically connected with a first electrical contact pin for providing electrical power; wherein the cartridge is magnetic or magnetically attractable by the communication magnet establishing a connecting force between the host device and the cartridge when the cartridge is detachably attached to the host device.

According to a fourth aspect of the invention a method of assembling an electronic cigarette is provided, said the electronic cigarette comprising: a host device; and a cartridge; wherein said cartridge is detachably attached to the host device; the host device comprises a first controller, a communication magnet, and a first electrical contact pin, wherein the communication magnet and the first electrical contact pin are electrically connected with the first controller; the cartridge comprises a cartridge body, a second controller, and a second electrical contact pin, wherein the second controller is electrically connected with the communication magnet for transmitting data to the first controller through the communication magnet, and the second electrical contact pin is electrically connected with the second controller and is electrically connected with the first electrical contact pin for providing electrical power; and the communication magnet provides a connecting force between the host device and the cartridge when the cartridge is detachably attached to the host device; said method comprising: inserting the cartridge into the host device until the communication magnet attracts the cartridge by magnetic force, establishing an electrically conducting contact of the cartridge with the communication magnet and the second electrical contact pin; sending a random dynamic code from the first controller to the second controller through the communication magnet; upon receiving the random dynamic code by the second controller, sending in return a feedback code to the first controller through a preset encoding rule; upon receiving the feedback code by the first controller, decoding the feedback code and determining whether the feedback code is authentic; and upon the determination that the feedback code is authentic, outputting electric power to the second electrical contact pin through the first electrical contact pin.

DETAILED DESCRIPTION OF THE INVENTION

According to the invention, the disadvantage in the prior art is overcome that the magnet only performs a single function, namely magnetic attraction between the host device and the cartridge, while according to the invention, the magnet is additionally used for transmitting signals.

The embodiments of the present invention are implemented as follows.

The embodiment of the present invention provides an electronic cigarette using magnet for communication, comprising: a cartridge and a host device.

The host device comprises a host device bracket, a first controller, a communication magnet, and a first electrical contact pin. The first controller is disposed on the host device bracket, and the communication magnet is disposed on the host device bracket and is electrically connected to the first controller. The first electrical contact pin is arranged on the host device bracket and is electrically connected to the first controller.

The cartridge comprises a cartridge body, a second controller, and a second electrical contact pin. The second controller is disposed on the cartridge body and transmits data to the first controller through the communication magnet. The second electrical contact pin is electrically connected with the second controller, and the second electrical contact pin is engaged with the first electrical contact pin to transmit electric energy.

By using the communication magnet as the data transmission medium, the number of electrical contact pins can be reduced, such that there is no need to leave the redundant space for the electrical contact pins, thereby reducing the space occupation. By using the magnet that is provided already for holding the cartridge in the host device for transmitting signals, this substitutes at least for one electrical contact pin without requiring any additional component parts.

In addition, the electronic cigarette using a magnet for communication provided according to the embodiments of the present invention may also have the following additional technical features.

In an optional embodiment of the present invention, the cartridge and the host device are detachably connected with each other through the communication magnet.

The communication magnet, which is able to not only play the role of communication, but also realize the detachable connection, can greatly reduce the space occupation, and at the same time, users' good experience of a magnetic electronic cigarette can be retained.

In an optional embodiment of the present invention, the MCU of the first controller sends a random dynamic code to the MCU of the second controller through the communication magnet, and the MCU of the second controller receives the random dynamic code, and afterwards returns a feedback code to the MCU of the first controller through a preset encoding rule. The MCU of the first controller receives and decodes the feedback code, and determines whether the feedback code is authentic.

The MCU is used as a management chip, which can easily confirm whether the cartridge matches with the host device, and has good confidentiality and is not easy to crack, in such a way an abnormal cartridge is unable to be used.

In an optional embodiment of the present invention, when the MCU of the first controller recognizes and determines that the feedback code is authentic, the MCU of the first controller reads the preset information of the cartridge and output electric energy to the second electrical contact pin through the first electrical contact pin based on the preset information.

Through the preset information, the host device can operate the cartridge in the most optimized working mode, giving users a better experience, for instance control the power and the power cycles based on the preset information.

In an optional embodiment of the present invention, the first controller comprises a communication module, and the communication module can transmit the preset information to a remote computer, for example to the cloud.

In an optional embodiment of the present invention, when the MCU of the first controller recognizes and determines that the feedback code is not the authentic code, the MCU of the first controller controls the first electrical contact pin to stop supplying power to the second electrical contact pin, and meanwhile the host device sends a reminder.

In an optional embodiment of the present invention, the cartridge body comprises an oil cup and a magnetic fixing frame, wherein the second controller is connected to the oil cup through the magnetic fixing frame and the communication magnet can be engaged with the magnetic fixing frame by magnetic attraction and can transmit data to the second controller through the magnetic fixing frame.

The magnetic fixing frame is able to not only hold the second controller and the oil cup in a fixed fashion, but also to cooperate with the communication magnet, thus most effectively using the limited installation space.

In an optional embodiment of the present invention, the host device bracket comprises a first mounting part, a second mounting part, and a third mounting part, wherein the first controller is disposed on the first mounting part, the communication magnet is disposed in the second mounting part, the first electrical contact pin is disposed on the third mounting part, the second mounting part is located above the first mounting part and close to the cartridge, the second mounting part is positioned at the edge position of the host device bracket, the third mounting part is located above the first mounting part, and the third mounting part is located at the central position of the host device bracket.

In the case of ensuring the normal implementation of the function, a relatively ample installation space is provided for other components, by arranging the first controller, the communication magnet and the first electrical contact pin.

In an optional embodiment of the present invention, the communication magnet is in a ring shape, the second mounting part is provided with a metal gasket on which the communication magnet is provided, and the metal gasket is electrically connected to the first controller.

The ring shaped communication magnet can be processed and manufactured more conveniently, with the corresponding manufacturing cost and purchase cost decreased. By providing the metal gasket, it can be ensured that the ring shaped communication magnet is electrically connected with the first controller normally.

In an optional embodiment of the present invention, the number of the first electrical contact pins is two, the number of the second electrical contact pins is two, wherein each of the first electrical contact pins is electrically connected to one second electrical contact pin, respectively.

The two first electrical contact pins cooperate with the two second electrical contact pins to realize power supply, which meets the usage demand, and the decreased number of electrical contact pins reduces the cost to a certain extent.

In order to more clearly describe the technical solutions of the embodiments of the present invention, embodiments of the invention will be discussed in the following by referring to the drawings. It should be understood that the following drawings only show some embodiments of the present invention, and therefore should not be regarded as limitation on the scope. For those ordinary skilled in the art, other related embodiments are apparent to the skilled artisan.

DETAILED DESCRIPTION OF THE DRAWINGS

Reference Numbers

Figure 1:
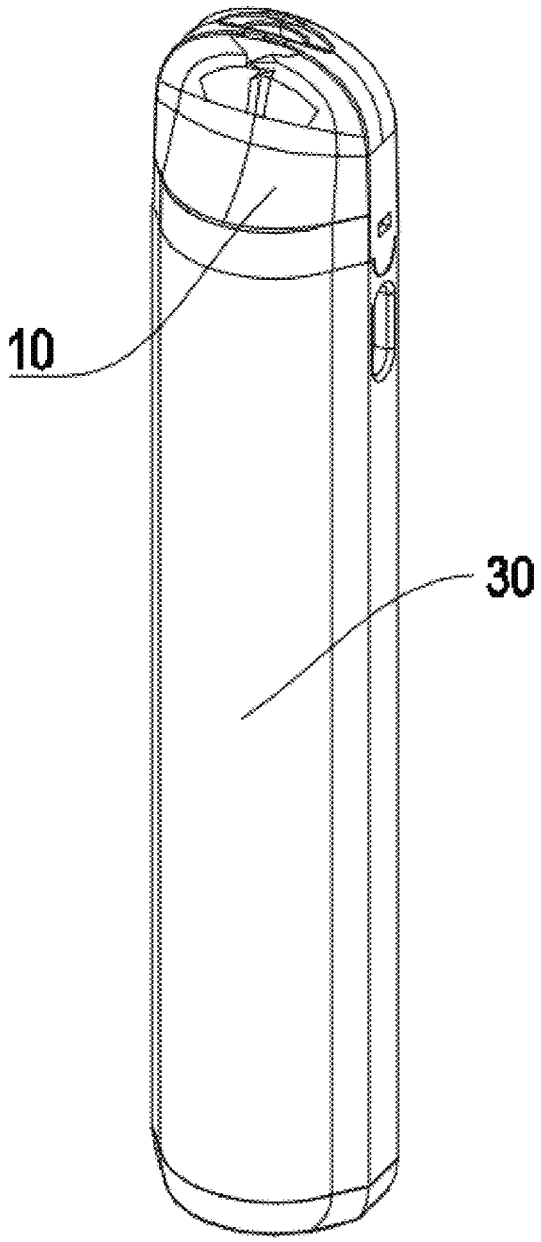
FIG. 1 is a schematic diagram of an electronic cigarette using magnet for communication according to an embodiment of the invention.

10—cartridge; 112—oil cup; 114—magnetic fixing frame; 116—atomizing wire; 118—top sealing gasket; 120—bottom sealing gasket; 12—second controller; 13—second electrical contact pin; 30—host device;

31—housing; 32—host device bracket; 321—first mounting part; 322—second mounting part; 3221—metal gasket; 323—third mounting part; 33—first controller; 34—communication magnet; 35—first electrical contact pin.

In order to make the objects of the invention, technical solutions and advantages of the embodiments of the present invention clearer, the technical solutions of the embodiments of the present invention will be described in more detail in conjunction with the drawings in the embodiments of the present invention. Obviously, the described embodiments are only a part of the embodiments of the present invention, but not all of the embodiments thereof. Generally, the components in the embodiments of the present invention described and shown in the drawings herein may be arranged and designed in various ways.

Therefore, the following detailed description of the drawings showing embodiments of the present invention is not intended to limit the scope of the present invention, but merely regarded as selected embodiments of the present invention. Based on the embodiments in the present invention, any other embodiments obtained by those skilled in the art without inventive effort shall fall within the protection scope of the present invention.

It should be noted that similar reference numbers and characters indicate similar items in the following figures. Therefore, once an item is defined in one figure, it is not needed to be further defined and explained in subsequent figures.

In the description of the present invention, it should be noted that the orientation or positional relationship indicated by the terminologies, "inner", "outer", etc. are based on the orientation or positional relationship shown in the drawings, or based on the orientation in which the product is usually placed in use. Such terminology is only for the convenience of describing the invention and simplifying the description, rather than indicating or implying that the device or components referred to must be located, constructed or operated in the specific orientation, and therefore it cannot be understood as limitation on the invention. In addition, the terminologies, "first", "second", etc. are only used for distinguishing something in the description, but cannot be understood as indicating or implying the relative importance.

In the description of the present invention, it should also be noted that, unless being clearly defined and limited otherwise, the terminologies, "set" and "connect" should be understood in a broad sense. For example, it may be a fixed connection, a detachable connection, or connected as one piece; and it can be a mechanical connection or an electrical connection; it can be directly connected or indirectly connected through an intermediate medium, and it may be internally communicated between two components. For those skilled in the art, the specific meanings of the above-mentioned terminologies in the present invention can be understood under specific circumstances.

Referring to FIG. 1, an embodiment of the present invention provides an electronic cigarette using a magnet for communication, comprising a cartridge 10 and a host device 30.

Figure 2:
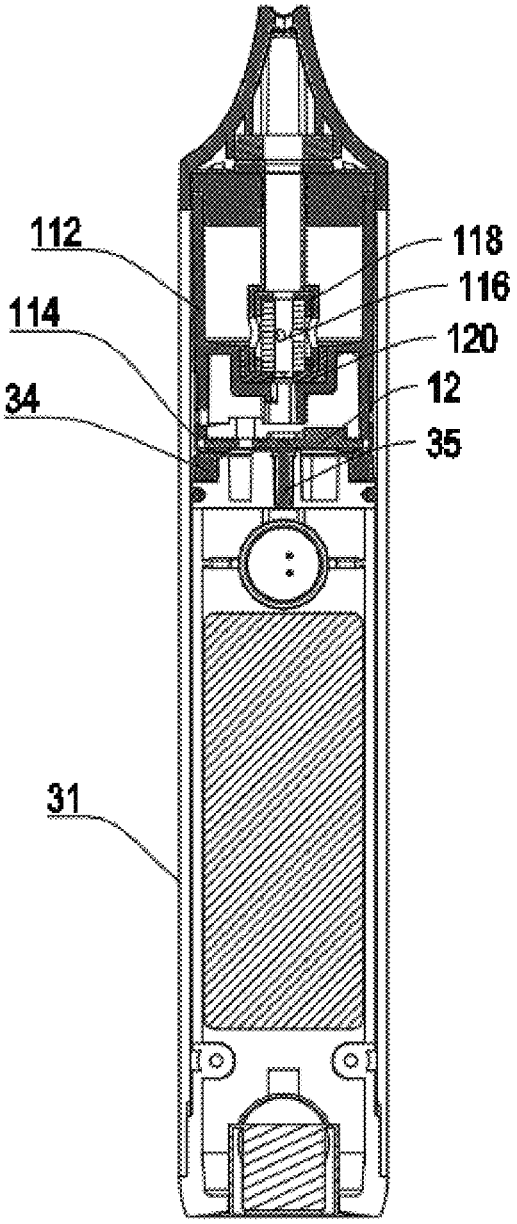
FIG. 2 is a sectional view of FIG. 1 in one direction.
Figure 3:
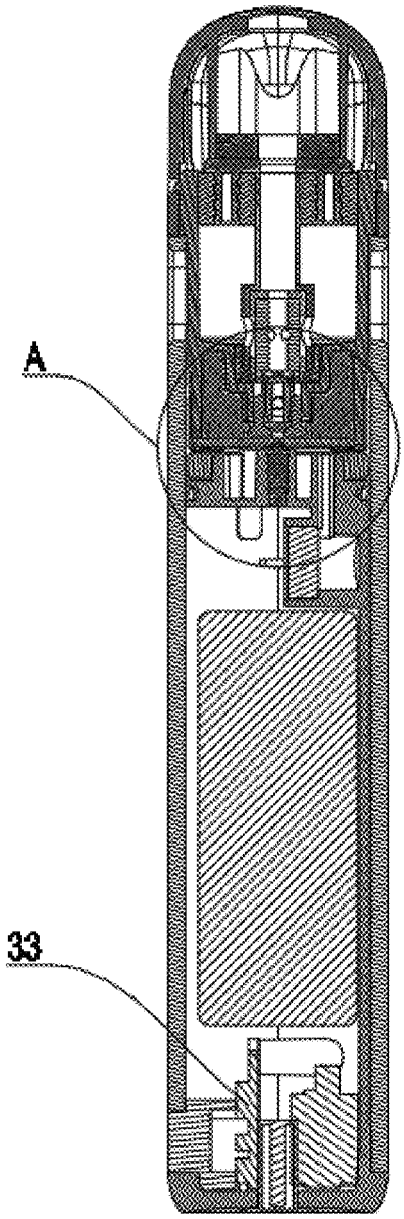
FIG. 3 is a sectional view of FIG. 1 in another direction.
Figure 4:
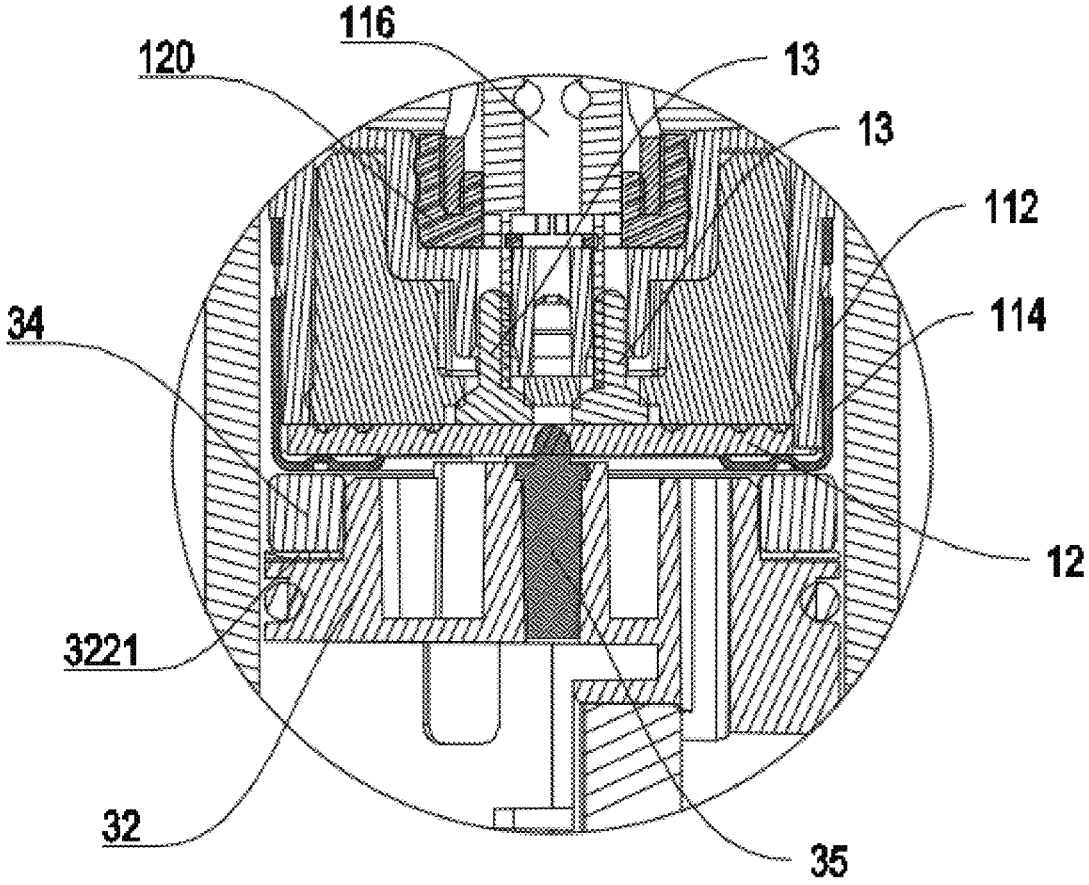
FIG. 4 is a partial enlarged view of part A of FIG. 3.

Referring to FIGS. 2 to 4, specifically, the host device 30 comprises a housing 31 as well as a host device bracket 32, a first controller 33, a communication magnet 34, and a first electrical contact pin 35 arranged in the housing 31. The first controller 33 is arranged at the host device bracket 32. The communication magnet 34 is arranged at the host device bracket 32 and electrically connected with the first controller 33. The first electrical contact pin 35 is arranged on the host device bracket and electrically connected with the first controller 33. The cartridge 10 comprises the body of the cartridge 10, the second controller 12, and the second electrical contact pin 13. The second controller 12 is arranged at the body of the cartridge 10 and transmits data with the first controller 33 through the communication magnet 34. The second electrical contact pin 13 is electrically connected with the second controller 12. The second electrical contact pin 13 is in electrical contact with the first electrical contact pin 35 for transmitting electric energy.

Meanwhile, in order to emphasize the communication magnet 34, the first electrical contact pin 35 and the similar in FIG. 2, section lines of some of the surrounding components are omitted.

It should be noted that a general electronic cigarette has a smoke pipe, an E-liquid cup, an atomizer and so on, which are also provided in the electronic cigarette using magnet for communication according to the present invention. The corresponding structures and the working methods of such components can be obtained by referring to the existing technology, and thus will not be repeated here.

In the above, the cartridge 10 and the host device 30 are detachably connected with each other through a communication magnet 34. The communication magnet 34 is able to not only play a communication role, but also realize a detachable connection, which can greatly reduce the space occupation, and also retain the users' good experience of the magnetic electronic cigarette.

By using the communication magnet 34 as a data transmission medium, the number of electrical contact pins can be reduced, and therefore there is no need to leave more space for the electrical contact pins, so as to reduce the space occupation. In this embodiment, the number of the first electrical contact pins 35 is two and the number of the second electrical contact pins 13 is two, wherein each first electrical contact pin 35 is electrically connected to one respective second electrical contact pin 13. The two first electrical contact pins 35 cooperate with the two second electrical contact pins 13 to establish power supply, which meets the requirements for use, and reduces the number of electrical contact pins so as to lower the cost to a certain extent.

Figure 5:
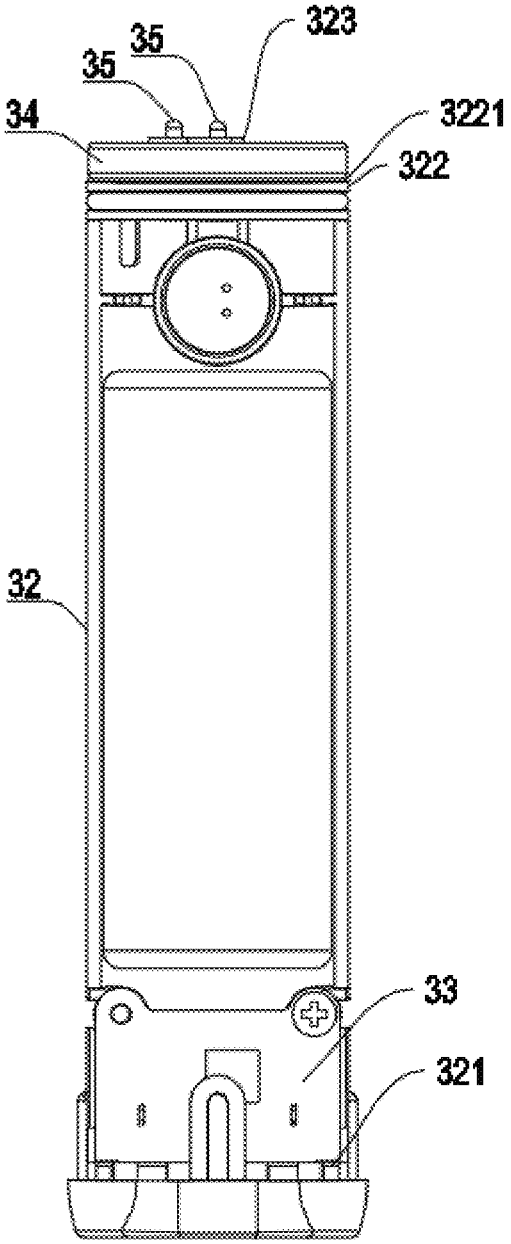
FIG. 5 is a schematic diagram of the host device with the housing hidden.
Figure 6:
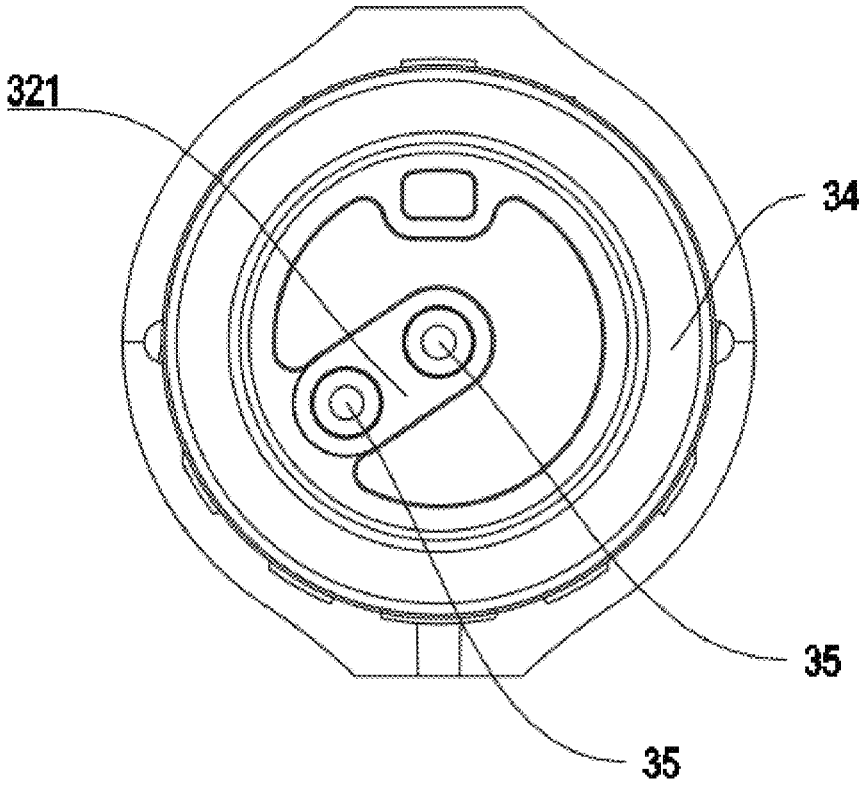
FIG. 6 is a top view of FIG. 5.

Referring to FIGS. 5 and 6, the host device bracket comprises a first mounting part 321, a second mounting part 322, and a third mounting part 323, wherein the first controller 33 is disposed on the first mounting part 321, and the communication magnet 34 is disposed on the second mounting part 322, the first electrical contact pin 35 is disposed on the third mounting part 323, the second mounting part 322 is located above the first mounting part 321 and close to the cartridge 10, the second mounting part 322 is positioned at the edge position of the host device bracket, and the third mounting part 323 is located above the first mounting part 321, and the third mounting part 323 is located at the central position of the host device bracket.

By arranging the first controller 33, the communication magnet 34 and the first electrical contact pin 35, on the basis of ensuring the implementation of the normal functions, a relatively ample installation space is also provided for other components. For example, it is possible to provide more space for a battery, so as to load a battery with larger capacity, increasing battery life and improving user experience. From the first electrical contact pin 35, a wire may run down to the first controller transmitting and/or receiving signals and/or electric power to the first controller 33.

In this embodiment, the communication magnet 34 is in a ring shape. The second mounting part 322 is provided with a metal gasket 3221, the communication magnet 34 is provided on the metal gasket 3221, and the metal gasket 3221 is electrically connected with the first controller 33. Instead of running a wire directly down from the first electrical contact pin 35 to the first controller, in this embodiment a wire (not shown) may run from the metal gasket 3221 down to the first controller 33 for transmitting and/or receiving signals and/or electric power to the first controller 33.

The communication magnet 34 in the ring shape is more convenient to be processed and manufactured, with the corresponding manufacturing cost and purchase cost lowered. By providing the metal gasket 3221, the normal electrical connection between the communication magnet 34 in the ring shape and the first controller 33 can be ensured.

In this embodiment, the body of the cartridge 10 comprises an oil cup 112 and a magnetic fixing frame 114. The second controller 12 is connected to the oil cup 112 through the magnetic fixing frame 114. The communication magnet 34 can be attached, by magnetic attraction, to the magnetic fixing frame 114, and transmit data with the second controller 12 through the magnetic fixing frame 114. The magnetic fixing frame 114 is able to not only fix the second controller 12 with the oil cup 112, but to also cooperate with the communication magnet 34, thus making full use of the limited installation space.

The magnetic fixing frame 114 is made of ferromagnetic material, which may be magnetic or in and of itself non-magnetic, as long as it can be attracted by the communication magnet 34. The magnetic fixing frame 114 covers the bottom of the oil cup 112. The second controller 12 in this embodiment comprises a PCB board. The PCB board is fixed with the oil cup 112 by the magnetic fixing frame 114. The second electrical contact pin 13 is arranged on the PCB board and can be electrically connected with the atomizing wire 116. The atomizing wire 116 is provided with a top sealing gasket 118 and a bottom sealing gasket 120, to prevent the E-liquid in the oil cup 112 from being leaked to affect the second electrical contact pin 13, the second controller 12 and other components. In addition, the first electrical contact pin 35 of the present invention is connected to the PCB board, and then electrically connected to the second electrical contact pin 13. The first electrical contact pin 35 and the second electrical contact pin 13 must not be in direct contact, as long as these can be electrically connected with each other and electrical energy can be output.

In this embodiment, both the first controller 33 and the second controller 12 use an MCU as a management chip.

Specifically, the MCU of the first controller 33 sends a random dynamic code to the MCU of the second controller 12 through the communication magnet 34, and the MCU of the second controller 12, after receiving the random dynamic code, returns a feedback code to the MCU of the first controller 33 through a preset encoding rule. The MCU of the first controller 33 receives and decodes the feedback code, and judges whether the feedback code is correct.

Using the MCU as the management chip can easily confirm whether the cartridge 10 matches with the host device 30, which has good confidentiality and is not easy to crack, making an inauthentic cartridge 10 unusable.

When the MCU of the first controller 33 recognizes and determines that the feedback code is correct, the MCU of the first controller 33 reads the preset information of the cartridge 10 and outputs electric energy to the second electrical contact pin 13 through the first electrical contact pin 35 according to the preset information. Through the preset information, the host device 30 can operate the cartridge 10 in an optimized fashion with regard to the operating parameters like electrical power and electrical power cycles, therefore giving a user a better user experience.

When the MCU of the first controller 33 recognizes and determines that the feedback code is incorrect, the MCU of the first controller 33 controls the first electrical contact pin 35 to stop supplying power to the second electrical contact pin 13 and at the same time the host device 30 sends out a warning on the device itself like an optical (e.g. a flashing light or light of a specific color) and/or an acoustic signal and/or a warning displayed by an external device such as a mobile phone or the like receiving signals by a wireless transmission such as by a Bluetooth signal that may be generated by the host device and/or the cartridge.

Optionally, the first controller 33 comprises a communication module, which can transmit the preset information to an external computer. The communication module may be Bluetooth or NFC, and the external computer may be a device such as a server or a mobile phone, which is convenient for users to learn their own use habits and details of the cartridge 10, and it is also convenient for suppliers to improve products based on the data.

Figure 7:
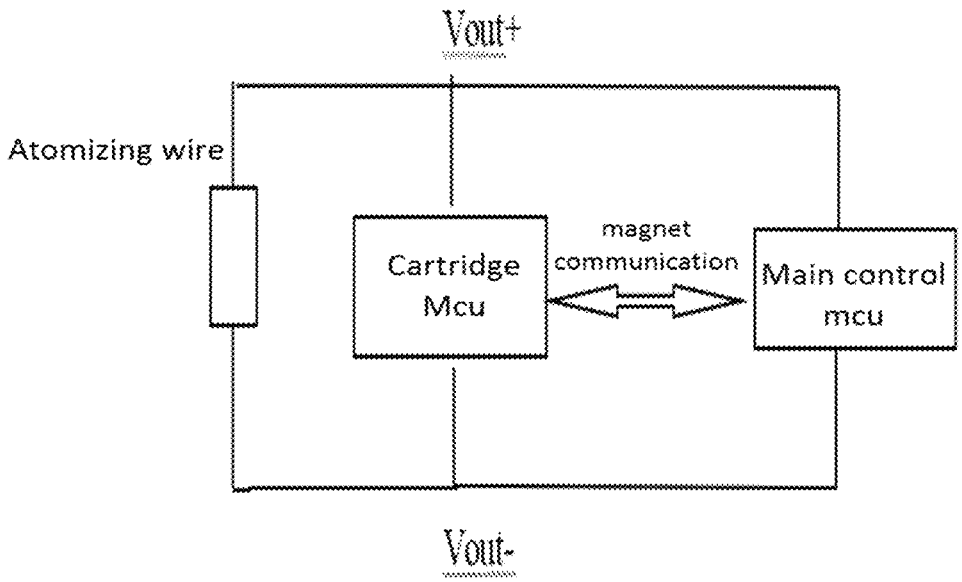
FIG. 7 is a schematic diagram indicating the control of an electronic cigarette using magnet for communication.

The principle of this embodiment is:

Referring to FIG. 7, the "main control mcu" in the figure refers to the first controller 33, and "cartridge Mcu" refers to the second controller 12, wherein the first controller 33 and the second controller 12 perform data communication via the communication magnet 34.

Specifically, when an electronic cigarette using magnet for communication is being used:

1. The main control mcu supplies power to the cartridge 10 for a short period of time by means of Vout+ and Vout− output, making it work normally;
2. After the cartridge Mcu works normally, it receives a random dynamic code from the main control mcu;
3. After receiving the random dynamic code, the cartridge Mcu returns a code to the host device main control mcu through a specific encoding rule;
4. After receiving the returned code (feedback code), the main control mcu decodes and judges whether the returned code is authentic, and if so, a handshake is passed; otherwise, if not authentic, the host device 30 will stop the power output and makes the prompt light flash;
5. After the host device 30 and the cartridge 10 have a successfully established a handshake, the host device 30 will read the information of the cartridge 10, comprising the type of E-liquid, the ingredient of the E-liquid, the date of manufacture, the place of production, the type of the atomizing wire, the output temperature, the reference resistance and the environment temperature, voltage for best taste, preheating temperature, preheating time period, output curve temperature and other relevant information about the cartridge;
6. After obtaining the relevant information, the host device 30 can perform relevant output control or transmit it to the server via Bluetooth or NFC.

Upon practice, the communication magnet 34 can realize the detachable connection (that is, the aforementioned handshake) and communication between the cartridge 10 and the host device 30. In this embodiment, a magnet is used as the communication magnet 34, and the communication magnet 34 is used as a lead, which is able to not only establish attachment by magnetic attraction, but also exchange data with the cartridge 10, reducing the number of electrical contact pins used. Consequently, space is saved and the product cost is limited. After the host device 30 has established a handshake with the cartridge 10, the related information of the cartridge 10 can also be obtained normally, so as to better control the output and give the user a better user experience as a whole.

However, if either the cartridge 10 or the host device 30 is inauthentic, both the handshake and the data interaction cannot be performed successfully, so as to prevent the inauthentic, incorrect data from being acquired in a non-authentic fashion, thus protecting the content of the data.

In summary, in the electronic cigarette using magnet communication according to the present invention, data is transmitted between the first controller 33 and the second controller 12 through the communication magnet 34, and electric energy is transferred through the first electrical contact pin 35 and the second electrical contact pin 13, which not only guarantees the normal use, but also reduces the space occupation and the number of electrical contact pins, and additionally the connection form of magnetic attraction retains, so as to give users better experience.

Only preferred embodiments of the invention are described above, but not intended to limit the present invention. For those skilled in the art, the invention can have various modifications and changes. Any modifications, equivalent substitutions, improvements, etc. made within the spirit and principle of the present invention shall be included in the protection scope of the present invention.

In the following, additional embodiments of the invention are discussed:

Embodiment 1

An electronic cigarette, comprising:

a host device; and a cartridge; wherein said cartridge is detachably attached to the host device;

the host device comprises a first controller, a communication magnet, and a first electrical contact electrical contact pin, wherein the communication magnet and the first electrical contact pin are electrically connected with the first controller;

the cartridge comprises a cartridge body, a second controller, and a second electrical contact pin, wherein the second controller is electrically connected with the communication magnet for transmitting data to the first controller through the communication magnet, and the second electrical contact pin is electrically connected with the second controller and is electrically connected with the first electrical contact pin for providing electrical power; and the communication magnet provides a connecting force between the host device and the cartridge when the cartridge is detachably attached to the host device.

Embodiment 2

The electronic cigarette according to embodiment 1, wherein the first electrical contact pin, the first controller and the communication magnet are arranged in a joint host device bracket.

Embodiment 3

The electronic cigarette according to embodiment 1 or 2, wherein a MCU of the first controller is configured to send a random dynamic code to a MCU of the second controller through the communication magnet, and the MCU of the second controller, after receiving the random dynamic code, is configured to return a feedback code to the MCU of the first controller through a preset encoding rule, and the MCU of the first controller is configured to receive and decode the feedback code, and to judge whether the feedback code is authentic.

Embodiment 4

The electronic cigarette according to claim 3, wherein the MCU of the first controller is configured to recognize and determine that the feedback code is authentic, and when determining an authentic feedback code, to read preset information of the cartridge, and to control outputting electric power to the second electrical contact pin through the first electrical contact pin according to the preset information.

Embodiment 5

The electronic cigarette according to claim one of the embodiments 1-4, wherein the first controller comprises a communication module that is configured to transmit the preset information to an external computer outside the electronic cigarette.

Embodiment 6

The electronic cigarette according to one of the embodiments 3-5, wherein the MCU of the first controller is configured to recognize and determine when the feedback code is not authentic and upon determination of a non-authentic feedback code to control stopping the supply of electric power from the first electrical contact pin to the second electrical contact pin, while at the same time, the first controller host device provides a non-authenticity warning.

Embodiment 7

The electronic cigarette according to one of the embodiments 1-6, wherein the cartridge body comprises an oil cup and a magnetic fixing frame, wherein the second controller is connected to the oil cup through the magnetic fixing frame, and the communication magnet is attached, by magnetic attraction, to the magnetic fixing frame when the cartridge is detachably attached to the host device to allow transmitting data from the second controller through the magnetic fixing frame.

Embodiment 8

The electronic cigarette according to one of the embodiments 2-7, wherein the host device bracket comprises a first mounting part, a second mounting part, and a third mounting part, wherein the first controller is disposed at the first mounting part, the communication magnet is disposed at the second mounting part, and the first electrical contact pin is disposed at the third mounting part;

the second mounting part is located above the first mounting part and close to the cartridge and at an edge position of the host device bracket; and the third mounting part is located above the first mounting part and at a central position of the host device bracket.

Embodiment 9

The electronic cigarette according to claim 8, wherein the communication magnet has a ring shape, the second mounting part is provided with a metal gasket, the communication magnet is provided adjacent to and in electrical contact with the metal gasket, and the metal gasket is electrically connected with the first controller.

Embodiment 10

The electronic cigarette according to one of the embodiments 1-9, wherein two first electrical contact pins are provided, two second electrical contact pins are provided, and each of the first electrical contact pins is respectively electrically connected with one of the second electrical contact pins.

Embodiment 11

An electronic cigarette host device, wherein the host device is configured to be detachably connected to a cartridge, said host device comprising:

a first controller, a communication magnet, and a first electrical contact pin, wherein the communication magnet and the first electrical contact pin are electrically connected with the first controller; and the communication magnet is configured to connect in an data transmitting fashion allowing date to be transmitted through said communication magnet to a second controller provided in the cartridge, wherein said communication magnet provides for both data transmission between the first and second controllers and for providing a magnetic attraction force between the host device and the cartridge when the cartridge is detachably attached to the host device.

Embodiment 12

The electronic cigarette host device according to claim 11, wherein the first electrical contact pin, the first controller and the communication magnet are arranged in a joint host device bracket.

Embodiment 13

The electronic cigarette host device according to embodiment 11 or 12, wherein the first controller comprises a communication module that is configured to transmit the preset information to an external computer outside the electronic cigarette.

Embodiment 14

The electronic cigarette host device according to one of the embodiments 11-13, wherein the first controller is configured to recognize and determine when a feedback code received by the first controller is not authentic and upon determination of a non-authentic feedback code to control stopping the supply of electric power, while at the same time providing a non-authenticity warning.

Embodiment 15

The electronic cigarette host device according to one of the embodiments 12-14, wherein the host device bracket comprises a first mounting part, a second mounting part, and a third mounting part, wherein the first controller is disposed at the first mounting part, the communication magnet is disposed at the second mounting part, and the first electrical contact pin is disposed at the third mounting part;

the second mounting part is located above the first mounting part and close to the cartridge and at an edge position of the host device bracket; and the third mounting part is located above the first mounting part and at a central position of the host device bracket.

Embodiment 16

The electronic cigarette host device according to embodiment 15, wherein the communication magnet has a ring shape, the second mounting part is provided with a metal gasket, the communication magnet is provided adjacent to and in electrical contact with the metal gasket, and the metal gasket is electrically connected with the first controller.

Embodiment 17

An electronic cigarette cartridge, wherein the cartridge is configured to be detachably connected to a host device, said cartridge comprising:

a cartridge body, a second controller, and a second electrical contact pin, wherein the cartridge is adapted to be electrically connected via a communication magnet in a data transmitting fashion to a first controller transmitting data through the communication magnet, and the second electrical contact pin is electrically connected with the second controller and is electrically connected with a first electrical contact pin for providing electrical power; wherein the cartridge is magnetic or magnetically attractable by the communication magnet establishing a connecting force between the host device and the cartridge when the cartridge is detachably attached to the host device.

Embodiment 18

The electronic cigarette cartridge according to embodiment 17, wherein the cartridge body comprises an oil cup and a magnetic fixing frame, wherein the second controller is connected to the oil cup through the magnetic fixing frame, and the communication magnet is attached, by magnetic attraction, to the magnetic fixing frame when the cartridge is detachably attached to the host device to allow transmitting data from the second controller through the magnetic fixing frame.

Embodiment 19

A method of assembling an electronic cigarette, said the electronic cigarette comprising:

a host device; and a cartridge; wherein said cartridge is detachably attached to the host device;

the host device comprises a first controller, a communication magnet, and a first electrical contact pin, wherein the communication magnet and the first electrical contact pin are electrically connected with the first controller;

the cartridge comprises a cartridge body, a second controller, and a second electrical contact pin, wherein the second controller is electrically connected with the communication magnet for transmitting data to the first controller through the communication magnet, and the second electrical contact pin is electrically connected with the second controller and is electrically connected with the first electrical contact pin for providing electrical power; and the communication magnet provides a connecting force between the host device and the cartridge when the cartridge is detachably attached to the host device; said method comprising:

inserting the cartridge into the host device until the communication magnet attracts the cartridge by magnetic force, establishing an electrically conducting contact of the cartridge with the communication magnet and the second electrical contact pin;

sending a random dynamic code from the first controller to the second controller through the communication magnet;

upon receiving the random dynamic code by the second controller, sending in return a feedback code to the first controller through a preset encoding rule;

upon receiving the feedback code by the first controller, decoding the feedback code and determining whether the feedback code is authentic; and upon the determination that the feedback code is authentic, outputting electric power to the second electrical contact pin through the first electrical contact pin.

Embodiment 20

The method according to embodiment 19, wherein upon determination by the first controller that the feedback code is authentic, reading preset information of the cartridge and controlling the outputting electric power to the second electrical contact pin through the first electrical contact pin according to the preset information.

What is claimed is:

1. An electronic cigarette, comprising:

a host device; and a cartridge; wherein said cartridge is detachably attached to the host device;

the host device comprises a first controller, a communication magnet, and a first electrical contact electrical contact pin, wherein the communication magnet and the first electrical contact pin are electrically connected with the first controller;

the cartridge comprises a cartridge body, a second controller, and a second electrical contact pin, wherein the second controller is electrically connected with the communication magnet for transmitting data to the first controller through the communication magnet, and the second electrical contact pin is electrically connected with the second controller and is electrically connected with the first electrical contact pin for providing electrical power; and the communication magnet provides a connecting force between the host device and the cartridge when the cartridge is detachably attached to the host device.

2. The electronic cigarette according to claim 1, wherein the first electrical contact pin, the first controller and the communication magnet are arranged in a joint host device bracket.

3. The electronic cigarette according to claim 1, wherein a MCU of the first controller is configured to send a random dynamic code to a MCU of the second controller through the communication magnet, and the MCU of the second controller, after receiving the random dynamic code, is configured to return a feedback code to the MCU of the first controller through a preset encoding rule, and the MCU of the first controller is configured to receive and decode the feedback code, and to judge whether the feedback code is authentic.

4. The electronic cigarette according to claim 3, wherein the MCU of the first controller is configured to recognize and determine that the feedback code is authentic, and when determining an authentic feedback code, to read preset information of the cartridge, and to control outputting electric power to the second electrical contact pin through the first electrical contact pin according to the preset information.

5. The electronic cigarette according to claim 4, wherein the first controller comprises a communication module that is configured to transmit the preset information to an external computer outside the electronic cigarette.

6. The electronic cigarette according to claim 3, wherein the MCU of the first controller is configured to recognize and determine when the feedback code is not authentic and upon determination of a non-authentic feedback code to control stopping the supply of electric power from the first electrical contact pin to the second electrical contact pin, while at the same time, the first controller host device provides a non-authenticity warning.

7. The electronic cigarette according to claim 1, wherein the cartridge body comprises an oil cup and a magnetic fixing frame, wherein the second controller is connected to the oil cup through the magnetic fixing frame, and the communication magnet is attached, by magnetic attraction, to the magnetic fixing frame when the cartridge is detachably attached to the host device to allow transmitting data from the second controller through the magnetic fixing frame.

8. The electronic cigarette according to claim 2, wherein the host device bracket comprises a first mounting part, a second mounting part, and a third mounting part, wherein the first controller is disposed at the first mounting part, the communication magnet is disposed at the second mounting part, and the first electrical contact pin is disposed at the third mounting part;

the second mounting part is located above the first mounting part and close to the cartridge and at an edge position of the host device bracket; and the third mounting part is located above the first mounting part and at a central position of the host device bracket.

9. The electronic cigarette according to claim 8, wherein the communication magnet has a ring shape, the second mounting part is provided with a metal gasket, the communication magnet is provided adjacent to and in electrical contact with the metal gasket, and the metal gasket is electrically connected with the first controller.

10. The electronic cigarette according to claim 1, wherein two first electrical contact pins are provided, two second electrical contact pins are provided, and each of the first electrical contact pins is respectively electrically connected with one of the second electrical contact pins.

11. A method of assembling an electronic cigarette, said the electronic cigarette comprising:

a host device; and a cartridge; wherein said cartridge is detachably attached to the host device;

the host device comprises a first controller, a communication magnet, and a first electrical contact pin, wherein the communication magnet and the first electrical contact pin are electrically connected with the first controller;

the cartridge comprises a cartridge body, a second controller, and a second electrical contact pin, wherein the second controller is electrically connected with the communication magnet for transmitting data to the first controller through the communication magnet, and the second electrical contact pin is electrically connected with the second controller and is electrically connected with the first electrical contact pin for providing electrical power; and the communication magnet provides a connecting force between the host device and the cartridge when the cartridge is detachably attached to the host device; said method comprising:

inserting the cartridge into the host device until the communication magnet attracts the cartridge by magnetic force, establishing an electrically conducting contact of the cartridge with the communication magnet and the second electrical contact pin;

sending a random dynamic code from the first controller to the second controller through the communication magnet;

upon receiving the random dynamic code by the second controller, sending in return a feedback code to the first controller through a preset encoding rule;

upon receiving the feedback code by the first controller, decoding the feedback code and determining whether the feedback code is authentic; and upon the determination that the feedback code is authentic, outputting electric power to the second electrical contact pin through the first electrical contact pin.

12. The method according to claim 11, wherein upon determination by the first controller that the feedback code is authentic, reading preset information of the cartridge and controlling the outputting electric power to the second electrical contact pin through the first electrical contact pin according to the preset information.

* * * * *